US009216430B2

(12) United States Patent
Hasselschwert et al.

(10) Patent No.: US 9,216,430 B2
(45) Date of Patent: Dec. 22, 2015

(54) SPRAY DEVICE HAVING CURVED PASSAGES

(75) Inventors: Daniel J. Hasselschwert, Sylvania, OH (US); Roger T. Cedoz, Curtice, OH (US)

(73) Assignee: Carlisle Fluid Technologies, Inc., Charlotte, NC (US)

( * ) Notice: Subject to any disclaimer, the term of this patent is extended or adjusted under 35 U.S.C. 154(b) by 439 days.

(21) Appl. No.: 13/620,606

(22) Filed: Sep. 14, 2012

(65) Prior Publication Data

US 2013/0082120 A1 Apr. 4, 2013

Related U.S. Application Data

(60) Provisional application No. 61/542,019, filed on Sep. 30, 2011.

(51) Int. Cl.

| | |
|---|---|
| ***B05B 7/02*** | (2006.01) |
| ***B05B 7/08*** | (2006.01) |
| ***B05B 7/24*** | (2006.01) |

(52) U.S. Cl.

CPC ..... *B05B 7/2424* (2013.01); *B05B 7/0815* (2013.01)

(58) Field of Classification Search

CPC .. B05B 5/0426; B05B 7/0815; B05B 7/2424; B05B 7/02; B05B 7/0823; B05B 7/0861

See application file for complete search history.

(56) References Cited

U.S. PATENT DOCUMENTS

| | | | | |
|---|---|---|---|---|
| 1,463,332 A | * | 7/1923 | Parker et al. | 239/296 |
| 2,614,000 A | * | 10/1952 | Reinhold | 239/295 |
| 2,814,530 A | * | 11/1957 | Portillo | 239/296 |
| 3,344,992 A | * | 10/1967 | Norris | 239/8 |
| 3,396,911 A | | 8/1968 | Norris | |
| 3,459,374 A | | 8/1969 | Probst | |
| 3,561,677 A | * | 2/1971 | Norris et al. | 239/705 |
| 3,773,263 A | | 11/1973 | Binoche | |
| 4,776,368 A | | 10/1988 | Drozd | |
| 6,612,506 B1 | | 9/2003 | Huang | |
| 6,808,122 B2 | | 10/2004 | Micheli | |
| 7,028,916 B2 | | 4/2006 | Micheli | |

(Continued)

FOREIGN PATENT DOCUMENTS

| | | |
|---|---|---|
| CN | 1062102 A | 6/1992 |
| CN | 2347673 Y | 11/1999 |

(Continued)

OTHER PUBLICATIONS

U.S. Appl. No. 12/046,249, filed Mar. 11, 2008, Drozd.

(Continued)

*Primary Examiner* — Darren W Gorman

(74) *Attorney, Agent, or Firm* — Fletcher Yoder P.C.

(57) ABSTRACT

A system includes an air cap configured to mount to a head of a spray device, wherein the air cap comprises at least one air passage having a curved flow path. A system may include a spray head having a first curved air passage that turns inwardly toward a central axis of the spray head, and a second curved air passage that turns inwardly toward the central axis of the spray head, wherein the first and second curved air passage are configured to direct first and second air flows inwardly toward a spray to shape the spray. A system may include a spray device having a liquid passage leading to a liquid outlet, and a curved air passage that gradually curves toward an air outlet.

21 Claims, 5 Drawing Sheets

(56) References Cited

U.S. PATENT DOCUMENTS

| | | | | |
|---|---|---|---|---|
| 7,201,336 | B2 * | 4/2007 | Blette et al. | 239/601 |
| 7,311,271 | B2 | 12/2007 | Micheli | |
| 7,568,635 | B2 | 8/2009 | Micheli | |
| 7,762,476 | B2 | 7/2010 | Micheli | |
| 7,789,327 | B2 | 9/2010 | Micheli et al. | |
| 7,926,733 | B2 | 4/2011 | Micheli | |
| 7,992,808 | B2 | 8/2011 | Micheli | |
| 2004/0031860 | A1 | 2/2004 | Micheli | |
| 2004/0046040 | A1 | 3/2004 | Micheli | |
| 2004/0262416 | A1 | 12/2004 | Micheli | |
| 2005/0006498 | A1 | 1/2005 | Micheli | |
| 2006/0000928 | A1 | 1/2006 | Micheli | |
| 2006/0065760 | A1 | 3/2006 | Micheli | |
| 2006/0214027 | A1 | 9/2006 | Micheli | |
| 2007/0221762 | A1 | 9/2007 | Micheli et al. | |
| 2008/0017734 | A1 | 1/2008 | Micheli et al. | |
| 2008/0048055 | A1 | 2/2008 | Micheli | |
| 2008/0185009 | A1 | 8/2008 | Chroncholas et al. | |
| 2008/0295768 | A1 | 12/2008 | Micheli et al. | |
| 2008/0296409 | A1 | 12/2008 | Micheli | |
| 2009/0148612 | A1 | 6/2009 | Micheli | |
| 2009/0173809 | A1 | 7/2009 | Huang | |
| 2009/0230218 | A1 | 9/2009 | Drozd | |
| 2009/0277976 | A1 | 11/2009 | Micheli et al. | |
| 2009/0302133 | A1 | 12/2009 | Micheli et al. | |
| 2010/0006673 | A1 | 1/2010 | Micheli | |
| 2010/0050870 | A1 | 3/2010 | Gajjar et al. | |
| 2010/0108784 | A1 | 5/2010 | Drozd et al. | |

FOREIGN PATENT DOCUMENTS

| | | | |
|---|---|---|---|
| CN | 1485142 | A | 3/2004 |
| CN | 1902002 | A | 1/2007 |
| DE | 9001265 | | 4/1990 |
| GB | 1569736 | | 6/1980 |
| RU | 2128087 | C1 | 3/1999 |
| RU | 2229945 | C2 | 6/2004 |
| RU | 2346755 | C2 | 2/2009 |
| WO | 2010072775 | A1 | 7/2010 |
| WO | 2012168933 | A2 | 12/2012 |

OTHER PUBLICATIONS

U.S. Appl. No. 12/613,372, filed Nov. 5, 2009, Drozd et al.
U.S. Appl. No. 12/908,656, filed Oct. 20, 2010, Drozd et al.
U.S. Appl. No. 13/356,513, filed Jan. 23, 2012, Micheli et al.
PCT International Search Report & Written Opinion; PCT Application No. PCT/US2012/055830; dated Jan. 22, 2013.
First Chinese Office Action for CN Application No. 201280056188.0, mailed Oct. 9, 2015, 10 pages.
Russian Decision of Grant for RU Application No. 2014117691, issued Aug. 19, 2015, 15 pages.

* cited by examiner

SPRAY DEVICE HAVING CURVED PASSAGES

CROSS REFERENCE TO RELATED APPLICATION

This application claims priority to and benefit of U.S. Provisional Patent Application No. 61/542,019 entitled "SPRAY DEVICE HAVING CURVED PASSAGES", filed Sep. 30, 2011, which is herein incorporated by reference in its entirety.

BACKGROUND

The invention relates generally to systems and methods for spraying substances, such as coating fluids (e.g., paint).

A variety of spray devices may be used to apply a spray to a target object. For example, spray devices often employ a gas, such as pressurized air, to atomize a liquid (e.g., paint) to generate a spray, which is then directed toward the target object to create a coating. Unfortunately, these spray devices flow the gas (e.g., air) through a series of air passages, which abruptly change in direction before exiting a head of the spray device. For example, the air passages may include a plurality of straight passages (e.g., separately drilled bores) that intersect one another at abrupt angles, which may be 45 to 90 degrees. As a result of these abrupt angles, the spray devices experience significant pressure drop and turbulence in the air flow (e.g., generally degraded air flow), which negatively impacts the spray forming downstream of the head of the spray device. These abrupt angles also generate noise as the air flow must abruptly change in direction. Furthermore, the degraded air flow may cause irregularities, deformities, and general non-uniformity in the spray. As a result, the spray may not provide a uniform coating on a target object. Accordingly, a need exists for an improved spray device.

BRIEF DESCRIPTION

A system includes an air cap configured to mount to a head of a spray device, wherein the air cap comprises at least one air passage having a curved flow path. A system may include a spray head having a first curved air passage that turns inwardly toward a central axis of the spray head, and a second curved air passage that turns inwardly toward the central axis of the spray head, wherein the first and second curved air passage are configured to direct first and second air flows inwardly toward a spray to shape the spray. A system may include a spray device having a liquid passage leading to a liquid outlet, wherein the spray device is configured to atomize a liquid from the liquid outlet to form a spray. The spray device also may include a curved air passage that gradually curves toward an air outlet, wherein the spray device is configured to at least partially shape the spray with an air flow from the air outlet.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
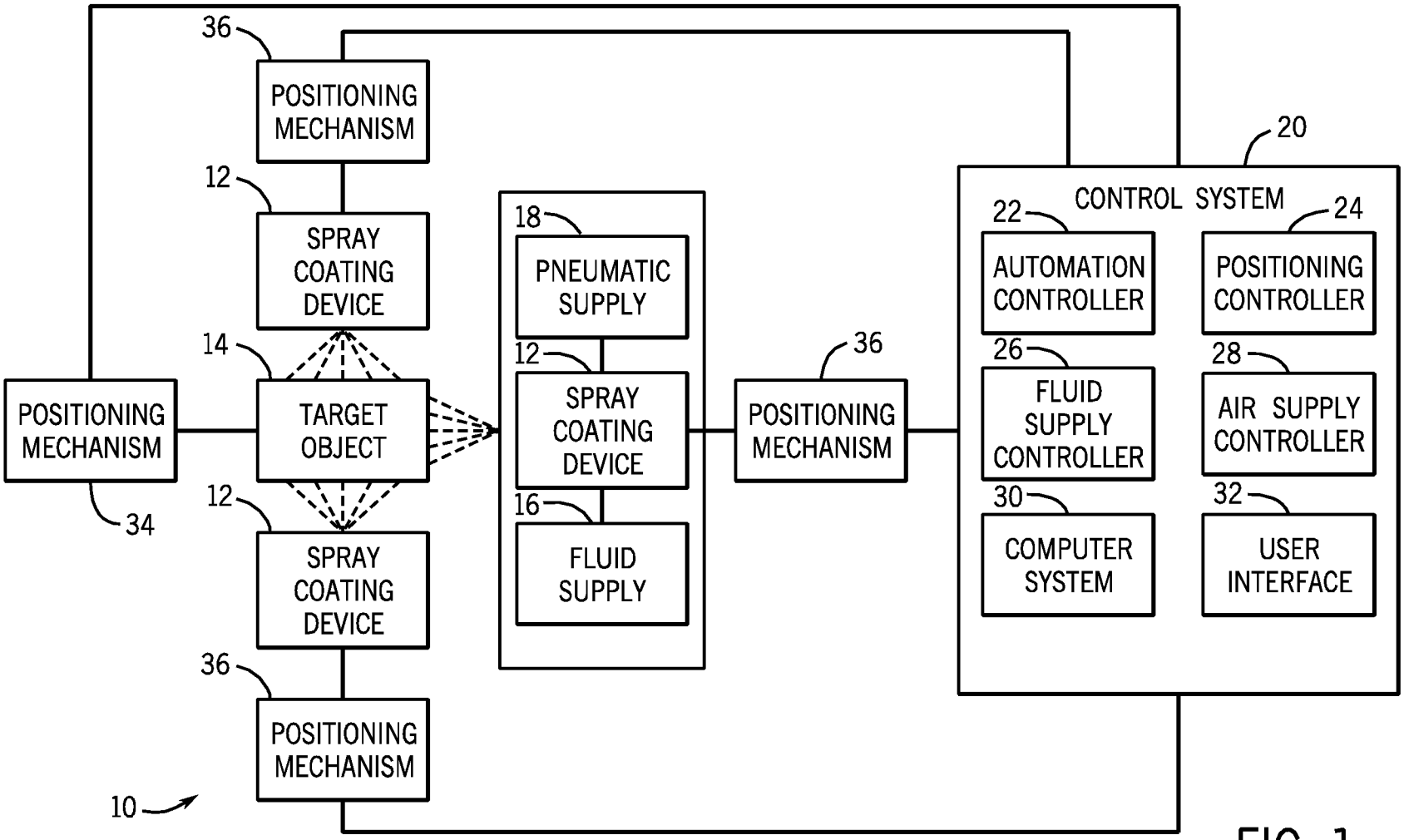
FIG. 1 is a diagram illustrating an exemplary spray coating system in accordance with certain embodiments of the present invention.

FIG. 1 is a flow chart illustrating an exemplary spray coating system 10, which comprises a spray coating device 12 for applying a desired coating to a target object 14. As discussed in detail below, the spray coating device 12 may include one or more curved passages (e.g., curved air passages) configured to reduce turbulence, pressure, drop, and noise associated with air flow through the spray coating device 12. Furthermore, the curved air passages may be configured to improve the spray formed by the spray coating device 12, e.g., by providing a more uniform air flow to shape the spray. In particular, the curved air passages may help uniformly distribute liquid droplets in the spray, thereby helping to increase the transfer efficiency of the spray onto a target object while also providing a more uniform coating on the target object.

In addition, the spray coating device 12 may include features to enable a non-conical spray shape and/or a spray shape characterized by a width that varies in a non-linear manner (e.g., curved manner) from an exit of the device 12 to the target object 14. In certain embodiments, the spray shape may be characterized by a cup-shaped or concave outer profile or periphery (e.g., outer edges), such that the width and/or cross-section of the spray shape is greater than a conical shape at a distance close to the exit of the spray coating device 12. In other embodiments, the spray shape may be characterized by a tulip shaped profile or periphery. As discussed below, the unique spray shaping features may enable a greater coverage area with a suitable velocity at a distance close to the exit of the spray coating device 12, thereby improving transfer efficiency and, thus, reducing waste and pollution. It should be noted that in the context of the present disclosure, the terms "conical" and "non-conical" when used to describe a spray shape are intended to refer to the general shape of the periphery of a cross-sectional view of the spray shape. These terms are not intended to suggest that spray particles travel only along the periphery of the spray shape. Rather, spray particles may indeed be transferred throughout the entire interior space of the spray shape.

The illustrated spray coating device 12 may comprise an air atomizer, a rotary atomizer, an electrostatic atomizer, or any other suitable spray formation mechanism. In certain embodiments, the spray coating device 12 may be described as a spray gun, which may include a gun-shape with a handle portion, a barrel or body portion coupled to the handle portion, and a trigger to engage and disengage one or more valves. However, the unique spray shaping features may be utilized on any type of spray device.

The spray coating device 12 may be coupled to a variety of supply and control systems, such as a fluid supply 16, an air supply 18, and a control system 20. The control system 20 facilitates control of the fluid and air supplies 16 and 18 and ensures that the spray coating device 12 provides an acceptable quality spray coating on the target object 14. For example, the control system 20 may include an automation controller 22, a positioning controller 24, a fluid supply controller 26, an air supply controller 28, a computer system 30, and a user interface 32.

The control system 20 also may be coupled to one or more positioning mechanisms 34 and 36. For example, the positioning mechanism 34 facilitates movement of the target object 14 relative to the spray coating device 12. The positioning mechanism 36 is coupled to the spray coating device 12, such that the spray coating device 12 can be moved relative to the target object 14. Also, the system 10 can include a plurality of the spray coating devices 12 coupled to positioning mechanisms 36, thereby providing improved coverage of the target object 14. Accordingly, the spray coating system 10 can provide a computer-controlled mixture of coating fluid, fluid and air flow rates, and spray pattern/coverage over the target object. Depending on the particular application, the positioning mechanisms 34 and 36 may include a robotic arm, conveyor belts, and other suitable positioning mechanisms.

Figure 2:
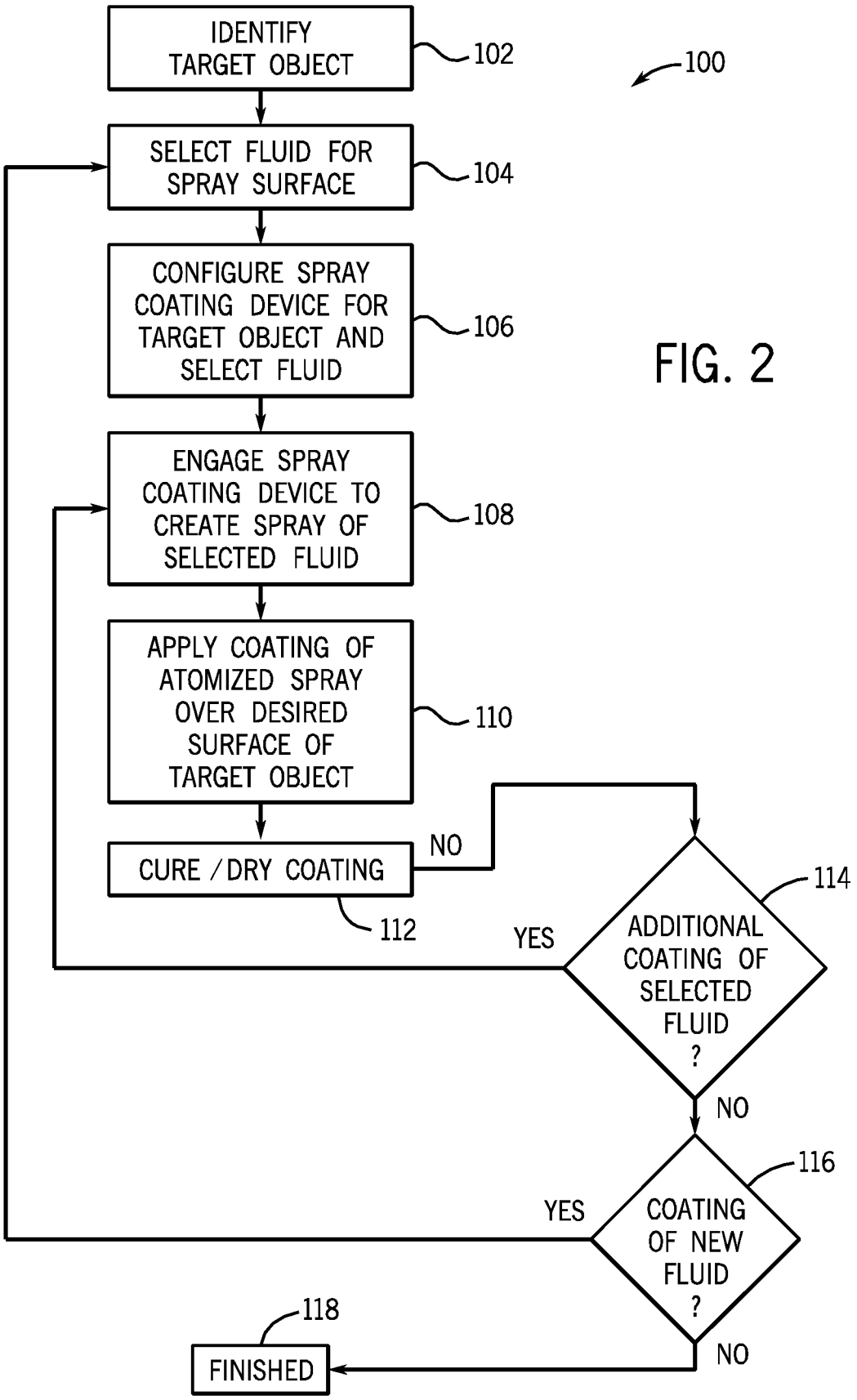
FIG. 2 is a flow chart illustrating an exemplary spray coating process in accordance with certain embodiments of the present invention.

FIG. 2 is a flow chart of an exemplary spray coating process 100 for applying a desired spray coating to the target object 14. As illustrated, the process 100 proceeds by identifying the target object 14 for application of the desired fluid (block 102). The process 100 then proceeds by selecting the desired fluid 40 for application to a spray surface of the target object 14 (block 104). The desired fluid may include a base coating fluid, a paint, a clear coat, a stain, and so forth. A user may then proceed to configure the spray coating device 12 for the identified target object 14 and selected fluid 40 (block 106). The target object 14 may include a vehicle, furniture, appliance, and so forth. As the user engages the spray coating device 12, the process 100 then proceeds to create an atomized spray of the selected fluid 40 (block 108). In certain embodiments discussed in detail below, the atomized spray has a non-conical spray shape, such as a cup-shape, a concave shape, or a tulip shape. The user may then apply a coating of the atomized spray over the desired surface of the target object 14 (block 110). The process 100 then proceeds to cure/dry (e.g., infrared curing lamp) the coating applied over the desired surface (block 112). If an additional coating of the selected fluid 40 is desired by the user at query block 114, then the process 100 proceeds through blocks 108, 110, and 112 to provide another coating of the selected fluid 40. If the user does not desire an additional coating of the selected fluid at query block 114, then the process 100 proceeds to query block 116 to determine whether a coating of a new fluid is desired by the user. If the user desires a coating of a new fluid at query block 116, then the process 100 proceeds through blocks 104-114 using a new selected fluid for the spray coating. If the user does not desire a coating of a new fluid at query block 116, then the process 100 is finished at block 118.

Figure 3:
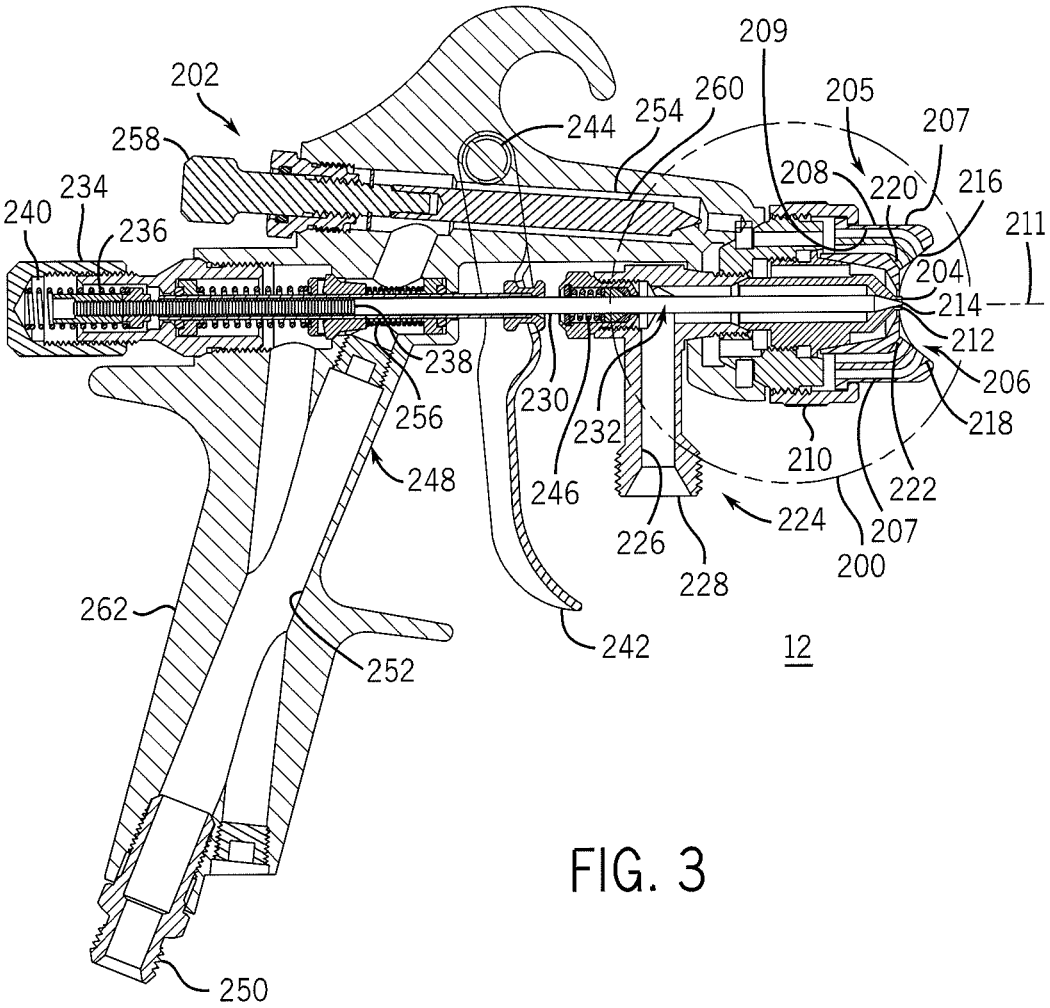
FIG. 3 is a cross-sectional side view of an exemplary spray coating device in accordance with certain embodiments of the present invention.

FIG. 3 is a cross-sectional side view illustrating an exemplary embodiment of the spray coating device 12. As illustrated, the spray coating device 12 comprises a spray tip assembly 200 coupled to a body 202. The spray tip assembly 200 includes a fluid delivery tip assembly 204. For example, a plurality of different types of spray coating devices may be configured to receive and use the fluid delivery tip assembly 204. The spray tip assembly 200 also includes a spray formation assembly 206 coupled to the fluid delivery tip assembly 204. The spray formation assembly 206 comprises an air cap 208, which is removably secured to the body 202 via a retaining nut 210. The air cap 208 includes a variety of air atomization orifices, such as a central atomization annular orifice 212 disposed about a fluid tip exit 214 from the fluid delivery tip assembly 204. The air cap 208 also may have one or more spray shaping orifices, such as spray shaping (e.g., air horn) orifices 216, 218, 220, and 222, which force the sprayed fluid to form a desired spray pattern (e.g., a non-conical pattern). The spray formation assembly 206 also may comprise a variety of other atomization mechanisms to provide a desired spray pattern and droplet distribution.

As discussed below, the air cap 208 may include curved passages to improve the air flow, reduce turbulence, reduce noise, and improve spray formation downstream of the spray coating device 12. In the illustrated embodiment of FIG. 3, the air cap 208 has a plurality of curved air passages 205, each having a series of curved air passages 207 and 209. The curved air passages 205 may replace non-curved air passages to improve operation of the spray coating device 12.

The body 202 of the spray coating device 12 includes a variety of controls and supply mechanisms for the spray tip assembly 200. As illustrated, the body 202 includes a fluid delivery assembly 224 having a fluid passage 226 extending from a fluid inlet coupling 228 to the fluid delivery tip assembly 204. The fluid delivery assembly 224 also comprises a fluid valve assembly 230 to control fluid flow through the fluid passage 226 and to the fluid delivery tip assembly 204. The illustrated fluid valve assembly 230 has a needle valve 232 extending movably through the body 202 between the fluid delivery tip assembly 204 and a fluid valve adjuster 234. The fluid valve adjuster 234 is rotatably adjustable against a spring 236 disposed between a rear section 238 of the needle valve 232 and an internal portion 240 of the fluid valve adjuster 234. The needle valve 232 is also coupled to a trigger 242, such that the needle valve 232 may be moved inwardly away from the fluid delivery tip assembly 204 as the trigger 242 is rotated counter clockwise about a pivot joint 244. However, any suitable inwardly or outwardly openable valve assembly may be used with embodiments of the present invention. The fluid valve assembly 230 also may include a variety of packing and seal assemblies, such as packing assembly 246, disposed between the needle valve 232 and the body 202.

An air supply assembly 248 is also disposed in the body 202 to facilitate atomization at the spray formation assembly 206. The illustrated air supply assembly 248 extends from an air inlet coupling 250 to the air cap 208 via air passages 252 and 254. The air supply assembly 248 also includes a variety of seal assemblies, air valve assemblies, and air valve adjusters to maintain and regulate the air pressure and flow through the spray coating device 12. For example, the illustrated air supply assembly 248 includes an air valve assembly 256 coupled to the trigger 242, such that rotation of the trigger 242 about the pivot joint 244 opens the air valve assembly 256 to allow air flow from the air passage 252 to the air passage 254. The air supply assembly 248 also includes an air valve adjustor 258 coupled to a needle 260, such that the needle 260 is movable via rotation of the air valve adjustor 258 to regulate the air flow to the air cap 208. As illustrated, the trigger 242 is coupled to both the fluid valve assembly 230 and the air valve assembly 256, such that fluid and air simultaneously flow to the spray tip assembly 200 as the trigger 242 is pulled toward a handle 262 of the body 202. Once engaged, the spray coating device 12 produces an atomized spray with a desired spray pattern (e.g., non-conical) and droplet distribution. Again, the illustrated spray coating device 12 is only an exemplary embodiment of the present invention. Any suitable type or configuration of a spraying device may benefit from the unique air cap fluid atomization and air shaping aspects of the present invention.

Figure 4:
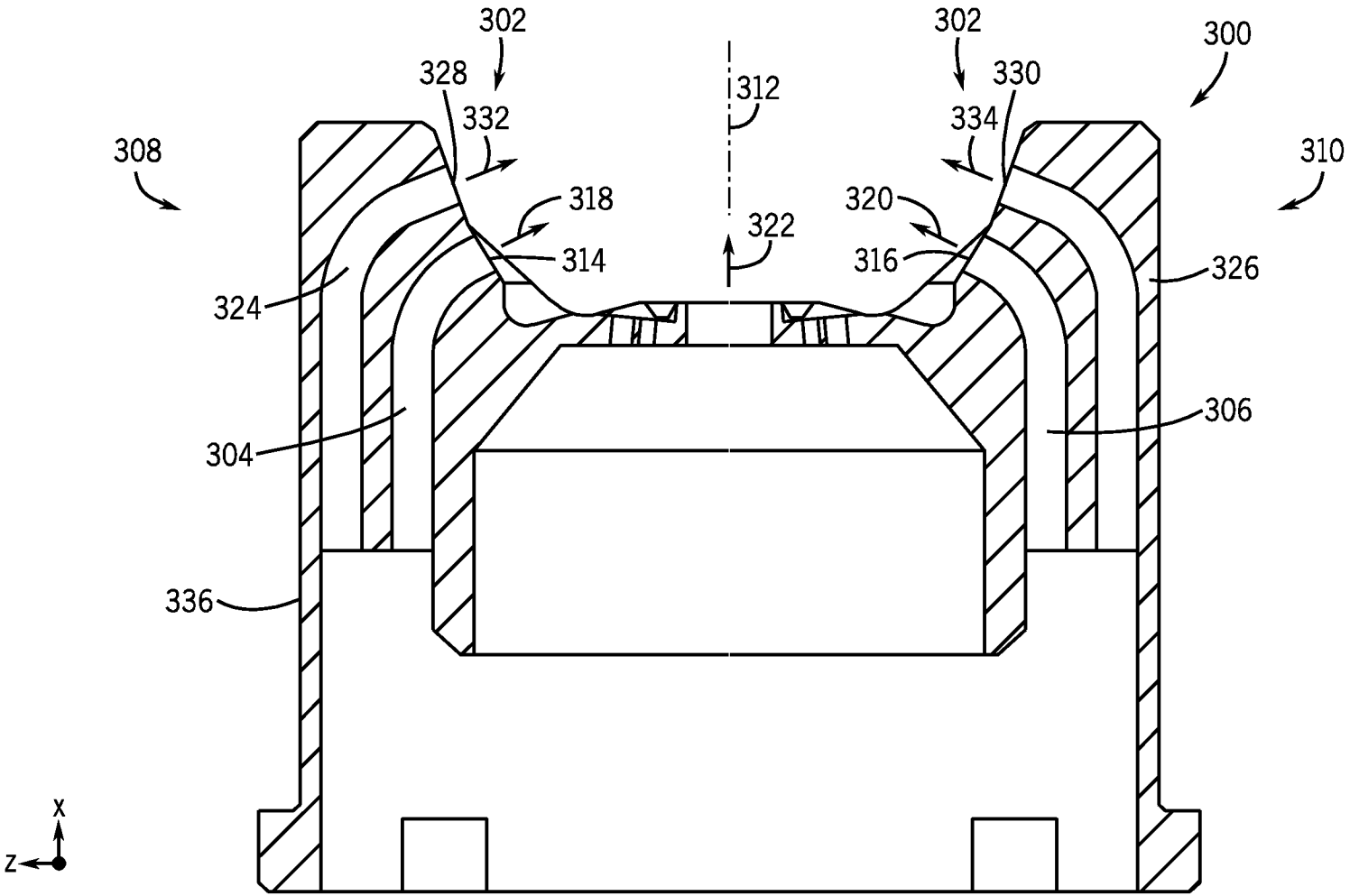
FIG. 4 is a cross-sectional side view of an embodiment of an air cap having curved passages.

FIG. 4 is a cross-sectional side view of an embodiment of an air cap 300 having curved passages 302 (e.g., curved air passages). As illustrated, the curved passages 302 include first and second curved air passages 304 and 306 on opposite sides 308 and 310 of a longitudinal axis 312 of the air cap 300. The first curved air passage 304 curves inwardly toward the longitudinal axis 312 and terminates at a first air outlet 314. The second curved air passage 306 curves inwardly toward the longitudinal axis 312 and terminates at a second air outlet 316. In operation, the first and second curved air passages 304 and 306 are configured to direct first and second air flows 318 and 320 toward a spray 322 to shape the spray 322. As further illustrated, the curved passages 302 include third and fourth curved air passages 324 and 326 on opposite sides 308 and 310 of the longitudinal axis 312 of the air cap 300. The third curved air passage 324 curves inwardly toward the longitudinal axis 312 and terminates at a third air outlet 328. The fourth curved air passage 326 curves inwardly toward the longitudinal axis 312 and terminates at a fourth air outlet 330. In operation, the third and fourth curved air passages 324 and 326 are configured to direct third and fourth air flows 332 and 334 toward the spray 322 to shape the spray 322.

These curved passages 302 are configured to improve the airflow to the spray 322, thereby improving the spray 322. In particular, the curved passages 302 may be configured to reduce turbulence, pressure, drop, and noise associated with air flow through the spray coating device 12. Furthermore, the curved passages 302 may be configured to improve the spray 322 formed by the spray coating device 12, e.g., by providing a more uniform air flow to shape the spray 322. In particular, the curved passages 302 may help uniformly distribute liquid droplets in the spray 322, thereby helping to increase the transfer efficiency of the spray 322 onto a target object while also providing a more uniform coating on the target object. In the illustrated embodiment, the curved passages 302 include four curved passages. In other embodiments, the curved passages 302 may include any number of curved passages, e.g., 1, 2, 3, 4, 5, 6, 7, 8, 9, 10, or more, in any suitable symmetrical or non-symmetrical arrangement. Furthermore, the illustrated curved passages 302 gradually curve inwardly toward the axis 312 over an angle of approximately 45 degrees at some radius of curvature. In other embodiments, the curved passages 302 may gradually curve inwardly or outwardly relative to the axis 312 over an angle of approximately 1 to 150 degrees, 5 to 120 degrees, 10 to 100 degrees, 20 to 90 degrees, 30 to 60 degrees, 40 to 50 degrees, or any specific angle therebetween. Furthermore, the radius of curvature of each curved passage 302 may range between approximately 0.1 to 5, 0.2 to 4, 0.3 to 3, 0.4 to 2, or 0.5 to 1 inch, or any other suitable radius of curvature.

The curved passages 302 of the air cap 300 may be formed in a variety of ways. In the illustrated embodiment, the air cap 300 may be a one-piece structure having the curved passages 302 formed integrally with an entire body 336 of the air cap 300. For example, the entire body 336 may be molded from a plastic material or cast from a metal material to form the air cap 300 with integral curved passages 302. In other embodiments, the a plurality of separate pieces may define the air cap 300 with the curved passages 302. For example, the curved passages 302 may be separate pieces (e.g., curved tubing) from the body 336. By further example, the curved passages 302 may be formed with multiple segments or sections of the body 336. Regardless of the manufacturing technique, the curved passages 302 provide a gradual curvature devoid of any abrupt changes in angle. In other words, the curved passages 302 do not experience any abrupt angles attributed to multiple straight passages intersecting one another.

Figure 5:
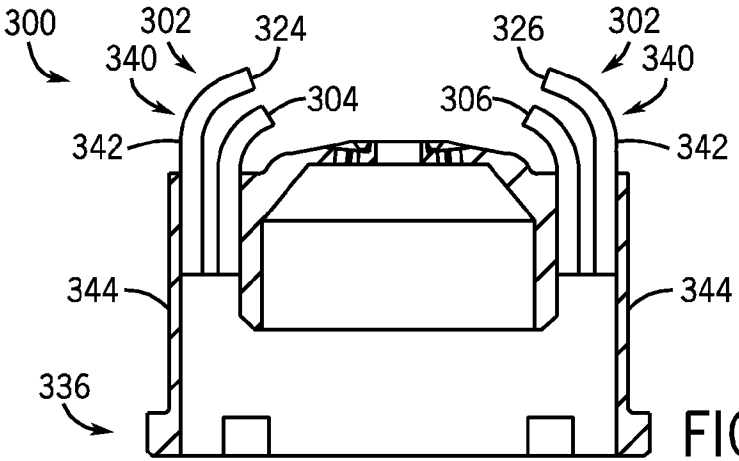
FIG. 5 is a cross-sectional side view of an embodiment of an air cap having curved passages, e.g., curved tubing protruding from a body portion of the air cap.

FIG. 5 is a cross-sectional side view of an embodiment of the air cap 300 having curved passages 302, e.g., curved tubing 340 protruding from the body 336 of the air cap 300. In the illustrated embodiment, each curved tubing 340 may be a separately formed tubing with a tubular wall 342, which gradually curves to form the curved passage 302 (e.g., curved passages 304, 306, 324, and 326). For example, each curved tubing 340 may be a metal tube, a plastic tube, a ceramic tube, a composite tube, or any suitable material defining a tube. In an embodiment having a metal curved tubing 340, the tubing 340 may be formed and then bent to a desired curvature. In an embodiment having a plastic tubing 340, the tubing 340 may be molded to define the desired curvature. However, any suitable construction of the curved tubing 340 may be employed in various embodiments. As illustrated, the curved tubing 340 protrudes away from the body 336, and is secured to the body 336 by a suitable mount 344. The mount 344 may include a removable or fixed fastener, such as a screw, bolt, clamp, adhesive, strap, snap-fit mechanism, latch, or any other suitable fastener. The mount 344 also may include an integral connection with the body 336, such as an overmolded material (e.g., plastic) around the tubing 340.

Figure 6:
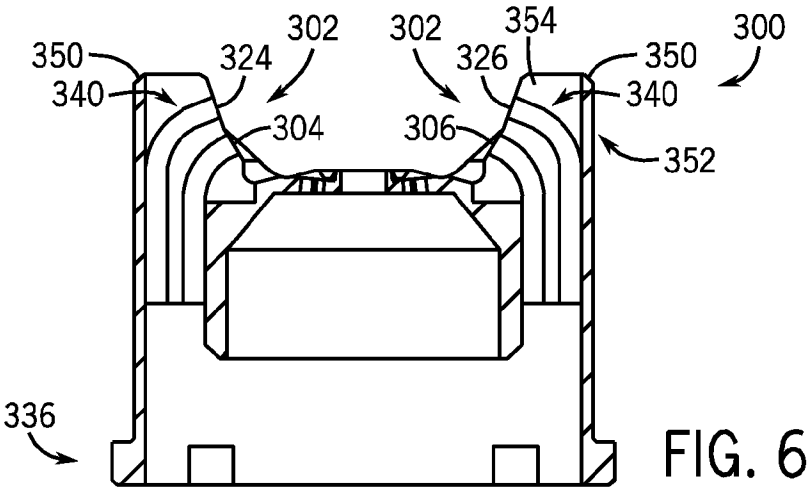
FIG. 6 is a cross-sectional side view of an embodiment of an air cap having curved passages, e.g., curved tubing surrounded by a protective wall.

FIG. 6 is a cross-sectional side view of an embodiment of the air cap 300 having curved passages 302, e.g., curved tubing 340 surrounded by a protective wall 350. For example, the protective wall 350 may define a hollow enclosure or casing 352, which generally surrounds the curved tubing 340 without directly contact each entire curved tubing 340. In other words, the protective wall 350 retains a hollow interior 354, and each curved tubing 340 generally passes through the hollow interior 354. In certain embodiments, the protective wall 350 may be made of a metal, plastic, ceramic, or composite material. Accordingly, the embodiment of FIG. 6 has a multi-piece construction of the protective wall 350 and each curved tubing 340.

Figure 7:
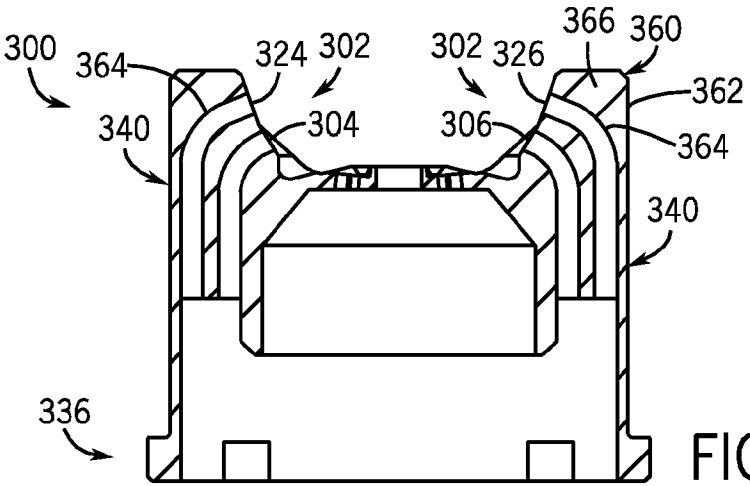
FIG. 7 is a cross-sectional side view of an embodiment of an air cap having curved passages, e.g., curved tubing encased within a protective material (e.g., an overmolded material)

FIG. 7 is a cross-sectional side view of an embodiment of the air cap 300 having curved passages 302, e.g., curved tubing 340 encased within a protective material 360 (e.g., an overmolded material) of the body 336. For example, the protective material 360 may define a solid structure 362 (e.g., non-hollow structure), which generally contacts each curved tubing 340 directly along its exterior surface 364. In other words, the protective material 360 retains a solid interior 366, and each curved tubing 340 generally passes through the solid interior 366. In certain embodiments, the protective material 360 may be made of a metal, plastic, ceramic, or composite material. For example, the curved tubing 340 may be molded, or overmolded, in place by a mold material (e.g., a plastic), such that the curved tubing 340 is substantially or entirely encapsulated and fixed in place by the mold material. Accordingly, the embodiment of FIG. 7 has a multi-piece construction of the protective material 360 and each curved tubing 340.

Figure 8:
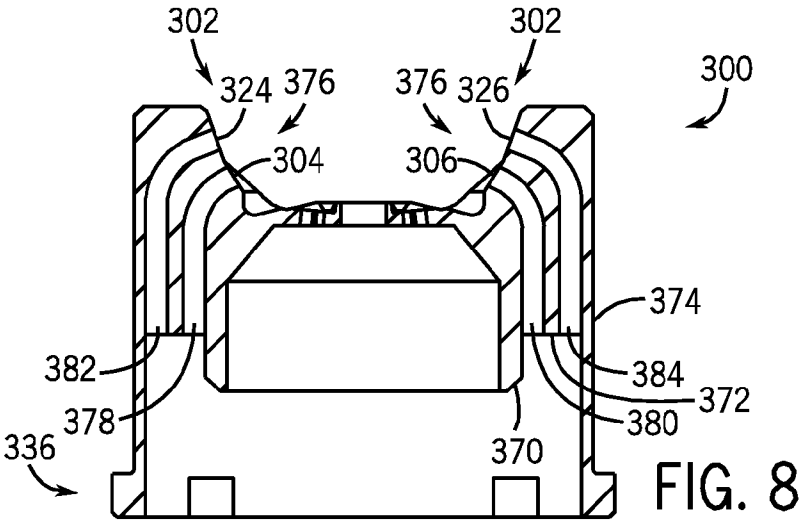
FIG. 8 is a cross-sectional side view of an embodiment of an air cap having curved passages, e.g., multiple sections defining the curved passages.

FIG. 8 is a cross-sectional side view of an embodiment of the air cap 300 having curved passages 302, e.g., multiple sections 370, 372, and 374 defining the curved passages 302. For example, each curved passage 302 may be formed as a curved groove 376 along an exterior surface of one of the sections 370, 372, or 374, and then the sections 370, 372, and 374 may be subsequently coupled together to define the body 336 of the air cap 300. In the illustrated embodiment, for example, the section 370 may be a first annular (or inner) section having curved grooves 376 (e.g., first and second curved grooves 378 and 380) along a first exterior surface. Similarly, the section 372 may be a second annular (or intermediate) section having curved grooves 376 (e.g., third and fourth curved grooves 382 and 384) along a second exterior surface. Finally, the section 374 may be a third annular (or outer) section surrounding the sections 370 and 372. In this manner, the curved grooves 376 may be formed along an exterior surface to simplify manufacturing, servicing, and so forth.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system, comprising:

an air cap configured to mount to a head of a spray device, wherein the air cap comprises:

a first shaping air passage having a first curved flow path and a first outlet, wherein the first shaping air passage curves inwardly toward a central axis of the air cap; and a second shaping air passage having a second curved flow path and a second outlet, wherein the second shaping air passage curves inwardly toward the central axis of the air cap;

wherein the first outlet and the second outlet are at different axial positions.

2. The system of claim 1, wherein at least the first or second shaping air passages comprise a curved tubing.

3. The system of claim 2, wherein the curved tubing is at least partially surrounded by a protective wall.

4. The system of claim 2, wherein the curved tubing is at least partially encased by a protective material.

5. The system of claim 4, wherein the protective material is an overmolded material.

6. The system of claim 1, wherein the air cap is a one-piece structure having the first and second shaping air passages.

7. The system of claim 1, wherein the air cap is a multi-piece structure having the first and second shaping air passages.

8. The system of claim 7, wherein a first piece of the multi-piece structure defines the first shaping air passage, and a second piece of the multi-piece structure at least partially surrounds the first piece.

9. The system of claim 1, wherein the first and second air passages are configured to direct an air flow toward a spray to shape the spray.

10. The system of claim 1, wherein the first and second shaping air passages are on opposite sides of a longitudinal axis of the air cap, and the first and second shaping air passage are configured to direct first and second air flows toward a spray to shape the spray.

11. The system of claim 10, comprising third and fourth shaping air passages on the opposite sides of the longitudinal axis of the air cap, the third shaping air passage comprises a third curved flow path that curves inwardly toward the longitudinal axis, the fourth shaping air passage comprises a fourth curved flow path that curves inwardly toward the longitudinal axis, and the third and fourth shaping air passages are configured to direct third and fourth air flows toward the spray to shape the spray.

12. The system of claim 1, comprising the spray device having the air cap.

13. The system of claim 12, wherein the spray device comprises an air valve configured to control an air flow through the first and second shaping air passages.

14. The system of claim 12, wherein the spray device comprises a liquid passage leading to the head of the spray device, and the spray device is configured to atomize the liquid to generate a liquid spray.

15. The system of claim 13, wherein the spray device comprises a liquid valve configured to control a liquid flow through the liquid passage.

16. The system of claim 12, wherein the spray device comprises a handle and a trigger configured to control operation of the spray device.

17. A system, comprising:

a spray head, comprising:

a first curved shaping air passage with a first outlet, wherein the first curved shaping air passage turns inwardly toward a central axis of the spray head; and a second curved shaping air passage with a second outlet, wherein the second curved shaping air passage turns inwardly toward the central axis of the spray head, wherein the first and second curved shaping air passages are configured to direct first and second air flows inwardly toward a spray to shape the spray;

wherein the first outlet and the second outlet are at different axial positions.

18. The system of claim 17, wherein the first and second curved shaping air passages comprise respective first and second curved tubing at least partially disposed in a support structure, the support structure comprises at least one of a protective wall or protective material, and the first and second curved shaping air passages protrude outwardly away from the support structure.

19. A system, comprising:

a spray device, comprising:

a liquid passage leading to a liquid outlet, wherein the spray device is configured to atomize a liquid from the liquid outlet to form a spray;

a first curved shaping air passage that gradually curves toward a first air outlet and a central axis of the spray device; and a second curved shaping air passage that gradually curves toward a second air outlet and the central axis of the spray device;

wherein the first and second outlets are at different axial positions and are configured to at least partially shape the spray with an air flow.

20. The system of claim 19, wherein the first and second air outlets are axially offset from the liquid outlet in a downstream direction away from the liquid outlet.

21. The system of claim 1, wherein the first shaping air passage comprises a first centerline and the second shaping air passage comprises a second centerline, and the first and second shaping air passages comprise respective inner and outer curvatures on opposite sides of the first and second centerlines, wherein the inner and outer curvatures curve towards the central axis of the air cap.

* * * * *